United States Patent [19]

Allan et al.

[11] 4,151,070

[45] Apr. 24, 1979

[54] STAGED SLURRY HYDROCONVERSION PROCESS

[75] Inventors: David E. Allan; William E. Lewis, both of Baton Rouge, La.

[73] Assignee: Exxon Research & Engineering Co., Florham Park, N.J.

[21] Appl. No.: 862,341

[22] Filed: Dec. 20, 1977

[51] Int. Cl.[2] ..... C10G 13/06; C10G 37/02

[52] U.S. Cl. ..... 208/59; 208/80; 208/102; 208/108; 208/212; 208/251 H; 208/264; 252/477 R

[58] Field of Search ..... 208/59

[56] References Cited

U.S. PATENT DOCUMENTS

| | | | |
|---|---|---|---|
| 3,131,142 | 4/1964 | Mills | 208/108 |
| 3,161,585 | 12/1964 | Gleim et al. | 208/264 |
| 3,579,436 | 5/1971 | Mounce | 208/59 |
| 3,583,902 | 6/1971 | Masologites et al. | 208/59 |
| 3,622,495 | 11/1971 | Gatsis et al. | 208/59 |
| 3,788,973 | 1/1974 | Wolk et al. | 208/59 |
| 4,066,530 | 1/1978 | Aldridge et al. | 208/112 |

*Primary Examiner*—Delbert E. Gantz
*Assistant Examiner*—G. E. Schmitkons
*Attorney, Agent, or Firm*—Marthe L. Gibbons

[57] ABSTRACT

A staged hydrocarbon hydroconversion process is provided in which a portion of the product boiling up to an atmospheric pressure distillation cut point of about 1050° F. is removed between the stages and in which the first stage is operated at lower severity than the second stage.

6 Claims, 1 Drawing Figure

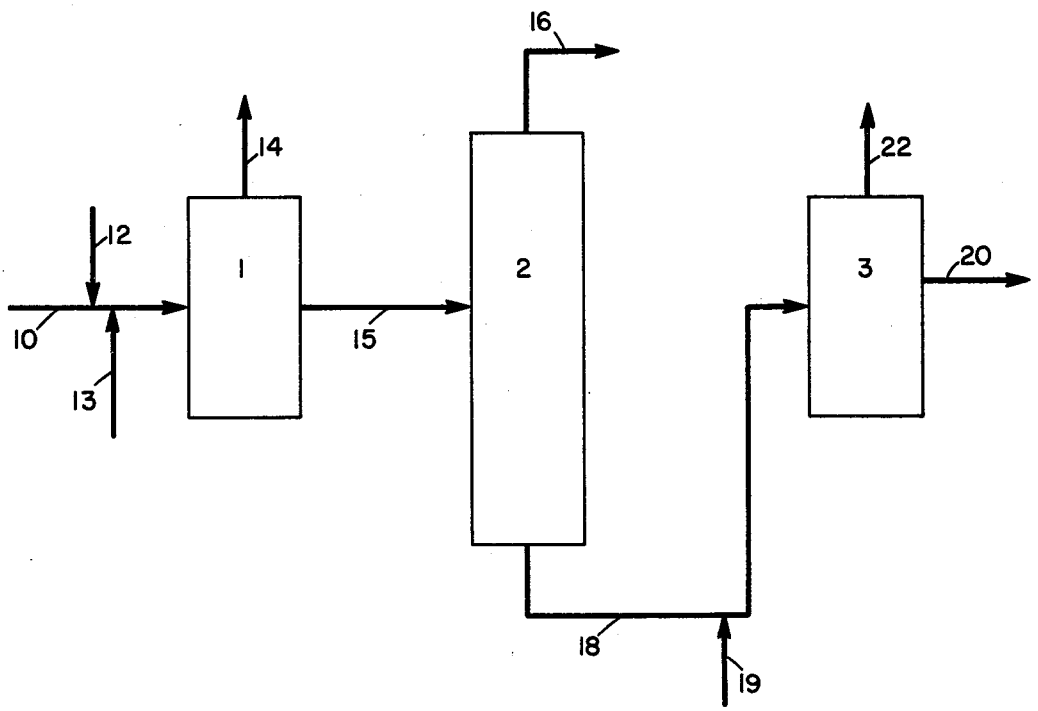
16
14
22
12
1
2
3
20
10
15
13
18
19

STAGED SLURRY HYDROCONVERSION PROCESS

BACKGROUND OF THE INVENTION

1. Field of the Invention

This invention relates to an improvement in a slurry type of hydrogen treatment of a hydrocarbonaceous oil. It particularly relates to a hydroconversion of a heavy hydrocarbonaceous oil comprising a catalyst dispersed in the oil.

2. Description of the Prior Art

Hydrorefining processes utilizing dispersed catalysts in admixture with a hydrocarbonaceous oil are well known.

U.S. Pat. No. 3,161,585 discloses a hydrorefining process in which a petroleum oil chargestock containing a colloidally dispersed catalyst selected from the group consisting of Groups VB and VIB, an oxide of said metal and the sulfide of said metal is reacted with hydrogen at hydrorefining conditions.

It is also known to use finely divided Group VIII metal components in a catalytic slurry process for the hydrogenative conversion of heavy oils.

U.S. Pat. No. 3,622,495 discloses a staged slurry hydroconversion process with intermediate product separation.

It has now been found that by separating the first hydroconversion zone oil product at a distillation cut point ranging from about 975° to about 1050° F., at atmospheric pressure and subjecting the heavier fraction, that is, the fraction above the distillation cut point to a second hydroconversion stage operated at more severe conditions than the first hydroconversion zone, hydrogen consumption is decreased relative to a one-stage process and the yield in desired boiling range product is increased.

SUMMARY OF THE INVENTION

In accordance with the invention there is provided, in a slurry hydroconversion process which comprises: (a) treating a slurry of a hydrocarbonaceous oil and particulate catalytic solids, in the presence of hydrogen, in a first hydroconversion zone; (b) separating from the resulting first hydroconversion zone normally liquid effluent at least a heavy oil comprising at least a portion of said catalytic solids; (c) passing at least a portion of said heavy oil to a second hydroconversion zone; (d) treating said heavy oil in the presence of hydrogen in said second hydroconversion zone, and (e) removing the resulting hydroconverted oil from said second hydroconversion zone, the improvement which comprises: maintaining said first hydroconversion zone at relatively mild hydroconversion conditions; maintaining said second hydroconversion zone at relatively more severe conditions than the conditions of said first hydroconversion zone; separating said hydroconversion zone normally liquid effluent at a distillation cut point ranging from about 975° to about 1050° F., said heavy oil separated in step (b) being the fraction boiling above said cut point.

BRIEF DESCRIPTION OF THE DRAWING

The FIGURE is a schematic flow plan of one embodiment of the invention.

DESCRIPTION OF THE PREFERRED EMBODIMENT

A preferred embodiment will be described with reference to the accompanying FIGURE.

Referring to the FIGURE, a hydrocarbonaceous oil, such as a petroleum vacuum residuum, is passed by line 10 into a first hydroconversion zone 1. Suitable hydrocarbonaceous oils to be used as feed for the first hydroconversion zone include heavy mineral oils; whole or topped petroleum crude oils, including heavy crude oils; residual oils such as petroleum atmospheric distillation tower residua and petroleum vacuum distillation tower residua; tars; bitumen; tar sand oils; shale oils; and liquids derived from coal liquefaction processes. The process is particularly well suited to heavy crude oils and residual oils which generally contain high content of metallic contaminants usually present in the form of organometallic compounds, a high content of sulfur compounds, a high content of nitrogenous compounds and a high Conradson carbon residue. Preferably the feedstock is a heavy hydrocarbon oil having at least 10 weight percent of material boiling above 1,050° F. at atmospheric pressure, more preferably having at least 25 weight percent of material boiling above 1,050° F. at atmospheric pressure. In the description of the preferred embodiment, a vacuum residuum will be described as the feed to the first hydroconversion zone for simplicity of description. At the start of the process, particulate catalytic solids and/or precursors of particulate catalytic solids are introduced into the oil stream by line 12. Precursors of catalytic solids may be in situ prepared catalysts derived from metal compounds that are added to the feed and subsequently converted to catalytic solids, such as described, for example, in U.S. application Ser. No. 745,394 filed Nov. 26, 1976 (now U.S. Pat. No. 4,066,530), the teachings of which are hereby incorporated by reference. Any suitable catalyst or catalyst precursor that would produce a desired hydroconversion of the oil in the presence of hydrogen can be used. The catalyst may, for example, be a Group VB or Group VIB or Group VIII metal, metal oxide, metal sulfide, or mixtures thereof.

The first hydroconversion zone is operated at relatively mild conditions. Suitable operating conditions for the first hydroconversion zone include a temperature ranging from about 725° to about 860° F., preferably from about 775° to about 840° F., a pressure ranging from about 1000 to about 4000 pounds per square inch absolute (psia), preferably from about 1300 to about 3000 psia, a liquid hourly space velocity (LHSV) ranging from about 0.4 to about 2.0, preferably from about 0.4 to about 1.0.

The term "hydroconversion" is used herein to designate a process conducted in the presence of hydrogen in which at least a portion of the heavy constituents including coke precursors (as measured by Conradson carbon residue) of the hydrocarbonaceous oil is converted to lower boiling hydrocarbon products while simultaneously reducing the concentration of nitrogenous compounds, sulfur compounds and metallic contaminants.

In the first hydroconversion zone, at least a portion of the heavy oil is converted to lower boiling normally liquid hydrocarbon products. A gaseous effluent comprising hydrogen and normally gaseous hydrocarbons is removed from hydroconversion zone 1 by line 14. This gas may be further separated by conventional means, if desired, to remove a portion of the gaseous hydrocarbons, as is well known in the art. The hydrogen-rich gas may be recycled to any of the hydroconversion zones of the process. Generally contaminants such as $H_2S$ are removed from the hydrogen-rich gas prior to recycle. The normally liquid product of the first hydroconversion zone is passed via line 15 to a separation zone 2. If desired, prior to passing the normally liquid product to separation zone 2 light boiling material may be separated therefrom, for example, in a vacuum preflash. Separation zone 2 may be a distillation pipestill in which the normally liquid product of the first hydroconversion zone is cut at a distillation cut point ranging from about 975° to about 1050° F., preferably at about 1050° F., to separate a heavy hydrocarbonaceous fraction boiling above the actual cut point and a lighter fraction boiling below the cut point. For example, if the cut point is a distillation cut point of about 1050° F., the resulting heavier fraction would be designated the 1050° F.+ fraction, although the 1050° F.+ fraction usually comprises some materials boiling below 1050° F., for example, from about 5 to 15 volume percent of materials boiling below 1050° F. The lighter fraction boiling below the cut point, for example, the fraction boiling up to about 1050° F. is removed from separation zone 2 by line 16. Separation zone 2 is operated at conditions which will permit separation of the heavier fraction from the lower boiling products at the desired cut point. Suitable conditions for the separation zone include a temperature ranging from about 650° to 800° F. and a pressure ranging from about 0.2 to 2 psia. The high cut point provides several advantages. For example, to achieve high conversion of the feed to liquid products in a single stage operation, high severity or long holding times are required. This leads to considerable recracking of the 650° to 1050° F. oil products thereby causing high hydrogen consumption. The heavy separated fraction boiling, for example, above 1050° F. is removed from the separation zone 2 and passed to a second hydroconversion zone 3. This heavy oil stream comprises the unconverted 1050° F.+ materials and the particulate solids. Hydroconversion zone 3 is operated at more severe conditions than the conditions of the first hydroconversion zone. By staging the hydroconversion conditions, the heavier portion of the feed, which is more difficult to convert, is subjected to more severe conditions without the necessity of subjecting the 650° to 1050° F. fraction to severe conditions which would result in recracking of the product. The second hydroconversion zone is operated at a temperature ranging from about 800° to about 860° F., preferably at a temperature ranging from about 820° to about 850° F. and at a pressure ranging from about 1000 to about 4000 psia, preferably from about 1300 to about 3000 psia, a liquid hourly space velocity ranging from about 0.1 to about 0.4, preferably from about 0.2 to less than about 0.4. A gaseous effluent comprising hydrogen and normally gaseous hydrocarbons is removed from hydroconversion zone 3 by line 22. This gas may be further separated by conventional means, if desired, to remove a portion of the gaseous hydrocarbons, as is well known in the art. The hydrogen-rich gas may be recycled to any of the hydroconversion zones of the process. Generally, contaminants such as $H_2S$ are removed from the hydrogen-rich gas prior to recycle. The normally liquid product of the second hydroconversion zone is removed from the second hydroconversion zone by line 20. The liquid effluent can be recovered, or, if desired, the liquid effluent of the second hydroconversion zone may be recycled to line 15. Furthermore, when the liquid effluent is recycled, it may be desirable to remove a purge stream from line 18 before passing the slurry of heavier oil and solids to the second hydroconversion zone.

A hydrogen-containing treat gas is introduced into line 10 by line 13 and into line 18 by line 19. Alternatively, the hydrogen-containing treat gas may be introduced directly into the hydroconversion zones. The following example is presented to further illustrate the invention.

EXAMPLE

The following table shows the estimated results from simulated staging of reactors compared to carrying out a slurry hydroconversion process in one stage, in a once-through manner. The molybdenum-containing catalyst was introduced into the oil feeds by way of molybdenum naphthenate which was converted in situ in the feed into molybdenum-containing solids.

TABLE

| | Simulated Reactor Staging | | | |
|---|---|---|---|---|
| | First Stage | Second Stage | Overall Results | Once-Through |
| Run No. | 1 | 2 | — | 3 |
| Type | Continuous Autoclave | Batch Autoclave | — | Continuous Autoclave |
| Feed | Lt. Arab 1025° F. + Vac. Resid | Unconverted 1050° F. + Product from first stage | — | Lt. Arab 1025° F. + Vac. Resid |
| T, ° F. | 833 | 835° F. | 834 | 834 |
| LHSV or Holding Time | 0.48 V/Hr/V | 4 hrs. | — | 0.35 |
| Mo, ppm | 350(1) | 350(2) | 350 | 350(1) |
| 650°-1050° F. yield, wt. % | 32.5 | 37.0 | 41.6 | 26.6 |
| 1050° F. + Conv., wt. % | 72.5 | 78.0 | 93.9 | 92.0 |
| $H_2$ Consumption, SCF/Bbl | 896 | 1907 | 1329 | 1750 |

(1)As molybdenum naphthenate.
(2)Fresh molybdenum naphthenate and solids generated from the first stage.

What is claimed is:

1. In a slurry hydroconversion process which comprises:

(a) treating a slurry of the hydrocarbonaceous oil and particulate catalytic solids in the presence of hydrogen, in a first hydroconversion zone;

(b) separating from the resulting first hydroconversion zone effluent, in a separation zone, at separation conditions, at least a heavy oil comprising at least a portion of said catalytic solids;

(c) passing solely at least a portion of said heavy oil comprising said portion of said catalytic solids to a second hydroconversion zone;

(d) treating said heavy oil in the presence of hydrogen in said second hydroconversion zone; and (e) removing the resulting hydroconverted oil from said second hydroconversion zone, the improvement which comprises: maintaining said first hydroconversion zone at relatively mild hydroconversion conditions; maintaining said second hydroconversion zone at relatively more severe conditions than the conditions of said first hydroconversion zone, said relatively more severe conditions including a temperature ranging from about 800° to about 860° F.; a pressure ranging from about 1000 to about 4000 psia and a liquid hourly space velocity ranging from about 0.1 to about 0.4; separating said hydroconversion zone normally liquid effluent at a distillation cut point ranging from about 975° to about 1050° F., said heavy oil separated in step (b) being the fraction boiling above said cut point, said separation conditions including a temperature ranging from about 650° to about 800° F. and a pressure ranging from about 0.2 to about 2 psia.

2. The process of claim 1 wherein said cut point is a distillation cut point of about 1050° F. at atmospheric pressure.

3. The process of claim 2 wherein an oil product having a distillation cut point boiling up to about 1050° F. at atmospheric pressure is recovered from said separation zone.

4. The process of claim 1 wherein at least a portion of said hydroconverted oil removed from said second hydroconversion zone is recycled to said separation zone.

5. The process of claim 4 wherein at least a portion of said heavy oil of step (b) is removed prior to passing said heavy oil to said second hydroconversion zone.

6. The process of claim 1 wherein said relatively mild hydroconversion conditions in said first hydroconversion zone include a temperature ranging from about 725° to about 860° F., a pressure ranging from about 1000 to about 4000 psia, and a liquid hourly space velocity ranging from about 0.4 to about 2.0.

* * * * *